US006118085A

United States Patent [19]

Chu

[11] Patent Number: 6,118,085

[45] Date of Patent: Sep. 12, 2000

[54] ELECTRICAL SWITCH

[75] Inventor: Raymond Wai Hang Chu, Chai Wan, The Hong Kong Special Administrative Region of the People's Republic of China

[73] Assignee: Defond Manufacturing Ltd., Chai Wan, The Hong Kong Special Administrative Region of the People's Republic of China

[21] Appl. No.: 09/339,936

[22] Filed: Jun. 25, 1999

[51] Int. Cl.[7] ..... H01H 9/26

[52] U.S. Cl. ..... 200/5 E; 200/5 B; 200/50.33

[58] Field of Search ..... 200/1 R, 1 B, 200/5 B, 5 C, 5 E, 5 EA, 5 EB, 50.32, 50.33, 50.36, 50.37

[56] References Cited

U.S. PATENT DOCUMENTS 2,968,704 1/1961 Woodward et al. ..... 200/18
3,472,973 10/1969 Stout ..... 200/5
3,970,806 7/1976 Distler ..... 200/5 R
4,143,252 3/1979 Moore ..... 200/5 B
4,362,912 12/1982 Woodward ..... 200/5 B

*Primary Examiner*—Michael Friedhofer
*Attorney, Agent, or Firm*—Leydig, Voit & Mayer

[57] ABSTRACT

An electrical switch includes a body, pressure-actuated buttons, switch terminals having respective parts forming internal switches, cam sliders extending side-by-side between the buttons and the parts for movement by the buttons to turn on and off the internal switches. The buttons include a first button for turning off all but the first of the internal switches. The other buttons turn on the other internal switches. The first button incorporates a movable cam engageable with the sliders for momentarily turning on the first internal switch after the other internal switches have all been turned off.

13 Claims, 4 Drawing Sheets

⊗ = STOP / MOMENTARY ON

● = CLOSED

○ = OPEN

ELECTRICAL SWITCH

The present invention relates to an electrical switch.

BACKGROUND OF THE INVENTION

It is known to have an electrical switch which comprises a body with press buttons and switch terminals and includes a switching mechanism formed by a set of cam sliders for making and breaking electrical connection between internal parts of the terminals. For use in a food processor, for example, the switch will usually have a specific button which is provided exclusively for momentarily switching on the food processor to perform a quick chop and/or mix after the processor has been switched off.

The invention provides an improved electrical switch of this kind, which is more convenient to use.

SUMMARY OF THE INVENTION

According to the invention, there is provided an electrical switch comprising a body, a plurality of actuators, a plurality of switch terminals having respective parts forming internal switches, a plurality of cam sliders extending side-by-side between the actuators and the terminal parts for movement by the actuators to turn on and off the internal switches, said actuators comprising a first actuator for turning off all the internal switches and at least one second actuator for turning on a said internal switch, wherein the first actuator incorporates a movable cam engageable with one of the sliders for momentarily turning on one of the internal switches after they have all been turned off.

Preferably, said one of the sliders is movable between a first position turning off said one of the internal switches and a second position turning on said one of the internal switches and is resiliently biassed towards the first position.

It is preferred that said one of the internal switches is used exclusively for the momentary turning on action.

More preferably, another slider which is adjacent to said one of the sliders is movable in one direction by the or each second actuator for subsequent movement in the opposite direction by the first actuator to turning off the other internal switch or switches.

Alternatively, another slider which is adjacent to said one of the sliders is movable in one direction by the or each second actuator for subsequent movement in the opposite direction by the first actuator to turning off the internal switches.

In a preferred embodiment, wherein said another slider has a side protrusion engageable with the movable cam and is movable in said one direction from a first position in which the protrusion prevents the movable cam from engaging with said one of the sliders to a second position in which the protrusion permits the movable cam to engage with said one of the sliders.

More preferably, said one of the sliders is resiliently biassed to move towards a first position turning off said one of the internal switches from a second position turning on said one of the internal switches, and the movable cam is resiliently biassed to pivot downwards for engaging with said one of the sliders at an inclined position facing against the direction in which said one of the sliders is resiliently biassed.

Alternatively, said one of the sliders is resiliently biassed to move towards a first position turning off said one of the internal switches from a second position turning on said one of the internal switches, the movable cam is resiliently biassed to pivot downwards for engaging with said one of the sliders, and the protrusion is provided below the movable cam and arranged in its first position to block the movable cam from engaging with said one of the sliders.

In a preferred arrangement, the movable cam is supported by the first actuator and is resiliently biassed to pivot towards a position engageable with said one of the sliders.

In a specific construction, said one of the sliders is formed with a notch for engagement by the movable cam.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 2:
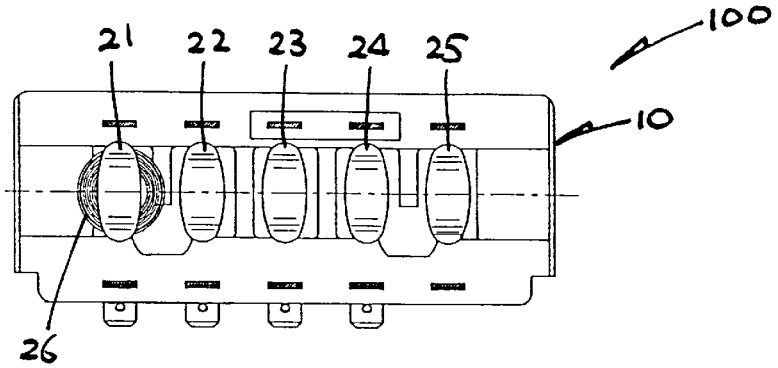
FIGS. 2 to 4 are top plan, bottom plan and end elevational views of the switch of FIG. 1.
Figure 1:
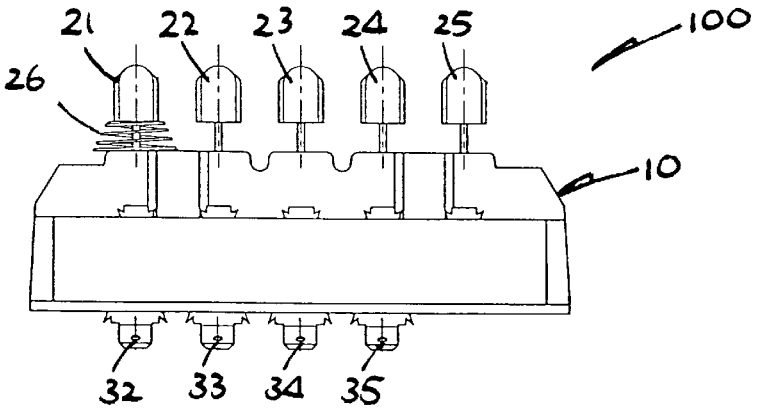
FIG. 1 is a side elevational view of an embodiment of an electrical switch in accordance with the invention.
Figure 4:
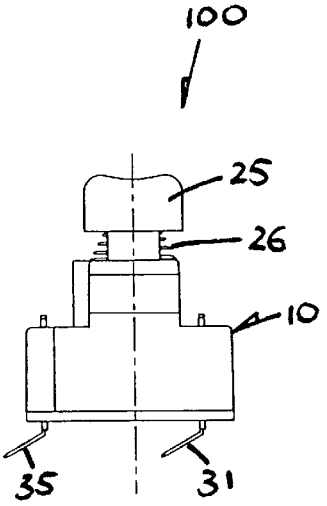
Figure 3:
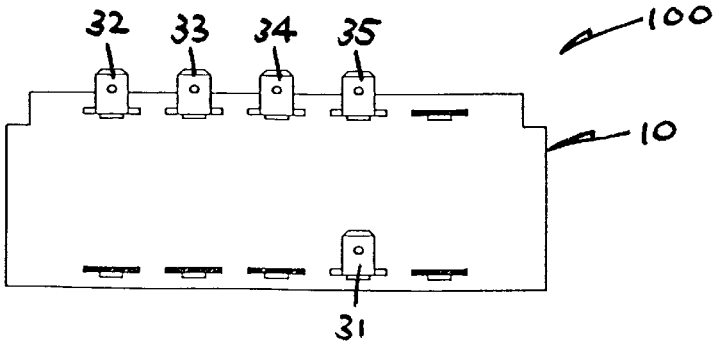
Figure 5:
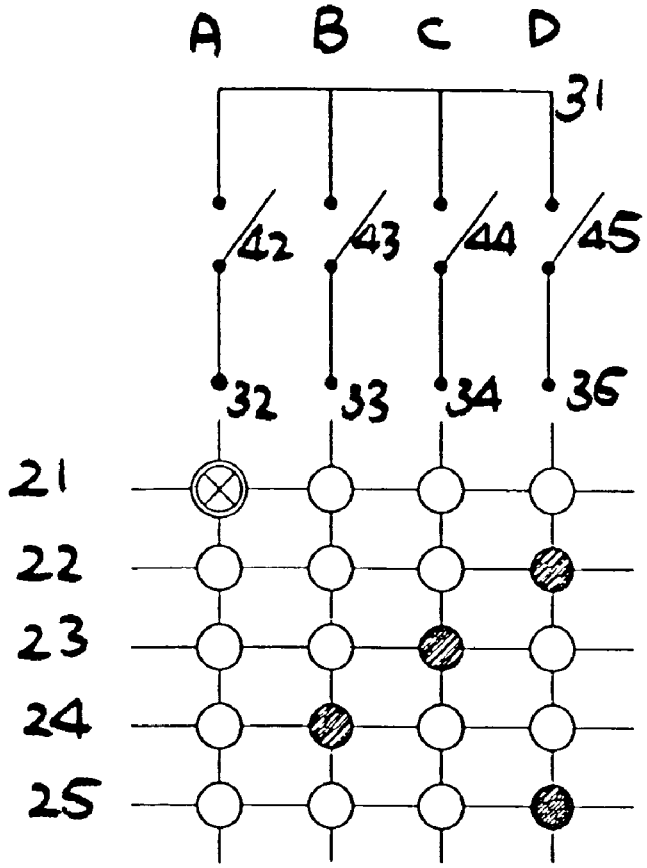
FIG. 5 is a schematic diagram illustrating the switching logic of the switch of FIG. 1.

Referring to the drawings, there is shown an electrical switch 100 embodying the invention, which switch 100 is generally known as a keyboard switch for controlling the operation of an electrical appliance such as a food processor or the like. The keyboard switch 100 comprises a elongate body 10, a series of five actuators in the form of pressure actuated buttons 21 to 25 on the top side of the body 10, and five switch terminals 31 to 35 on the bottom side of the body 10. The first button 21 is resiliently biassed upwards by a coil spring 26. The first terminal 31 is a common terminal, to which the other four terminals 32 to 35 may be connected by means of respective internal spring-loaded contact strips 42 to 45, thereby forming a series of four normally-open switches A, B, C, and D.

The switching logic of the keyboard switch 100 is designed as follows:

Depression Operation (1) Button 22 Closing switch D and opening any of the other switches A, B, and C that are closed.

(2) Button 23 Closing switch C and opening any of the other switches A, B, and D that are closed.

(3) Button 24 Closing switch B and opening any of other switches A, C, and D that are closed.

(4) Button 25 Closing switch D and opening any of other switches A, B, and C that are closed.

(5) Button 21

(a) Opening all of switches B, C, and D if any of them is closed.

(b) Momentarily closing switch A if all of switches B, C, and D are open

Operations (1) to (4) are for controlling the speed and/or direction of the food processor. Operation **(5*a*) is for switching off the food processor, and operation (5***b*) is for momentarily switching on the food processor for a quick chop and/or mix. Accordingly, the button 21 is assigned two functions, which is convenient because operation (5*b*) always follows operation (5*a*).

For such operations, the keyboard switch 100 incorporates one slider blade 60 and three slider blades 70 extending side-by-side between the-buttons 21 to 25 and the contact strips 42 to 45. In the drawings, only the relevant slider blade 70 which is adjacent to the slider blade 60 has been shown.

Each slider blade 70 includes a series of five upper recesses P having respective 45° inclined cam edges Q for action by the internal shafts, or the equivalents, of the corresponding buttons 21 to 25. It includes a series of four lower recesses R having respective half-width cam steps S, where appropriate, for acting on the corresponding contact strips 43 to 45 (switches B to D), with the first (leftmost) recess R being empty for not acting on the contact strip 42 (switch A). All the slider blades 70 are generally freely slidable in two opposite directions.

The use of the slider blades 70 to operate the switches B to D, as in operations (1) to (4), is generally known in the art. More or less than three such or similar slider blades 70 may be employed, depending on the switching logic.

The slider blade 60 is employed for operations (5*a*) and (5*b*). It includes one double-width upper recess T and three normal-width recesses U which are all empty for accommodating the bottom shaft ends of the corresponding buttons 21 to 25. It includes a series of four lower recesses V, with only the first (leftmost) recess V having a half-width cam step W for acting on the contact strip 42 (switch A). A coil spring X is used to resiliently bias the slider blade 60 toward the left position.

The bottom of the upper recess T includes a middle notch H, and the adjacent slider blade 70 has a protruding side peg I above and close to the notch H. The bottom shaft end of the button 21 supports a movable cam J which is provided above the peg I and has a protruding end K pointing downwards for engagement with the notch H. The cam J is pivotable about a horizontal axis M on the left side of the peg I, and is resiliently biassed by an elbow spring L to bear against the right side of the peg I. More specifically, the cam J is arranged to have its end K pointing also to the right, at an inclined position facing against the direction (to the left) in which the slider blade 60 is biassed by the spring X.

Apart from the first (leftmost) cam edge Q, all the other four cam edges Q of the slider blade 70 are inclined in the same direction such that the slider blade 70 will slide to the right position when any one of the buttons 22 to 25 is depressed. The first cam edge Q is inclined in the opposite direction to enable the button 21, upon depression, to slide the slider blade 70 to the left.

Figures 6A, 6B, 6C:
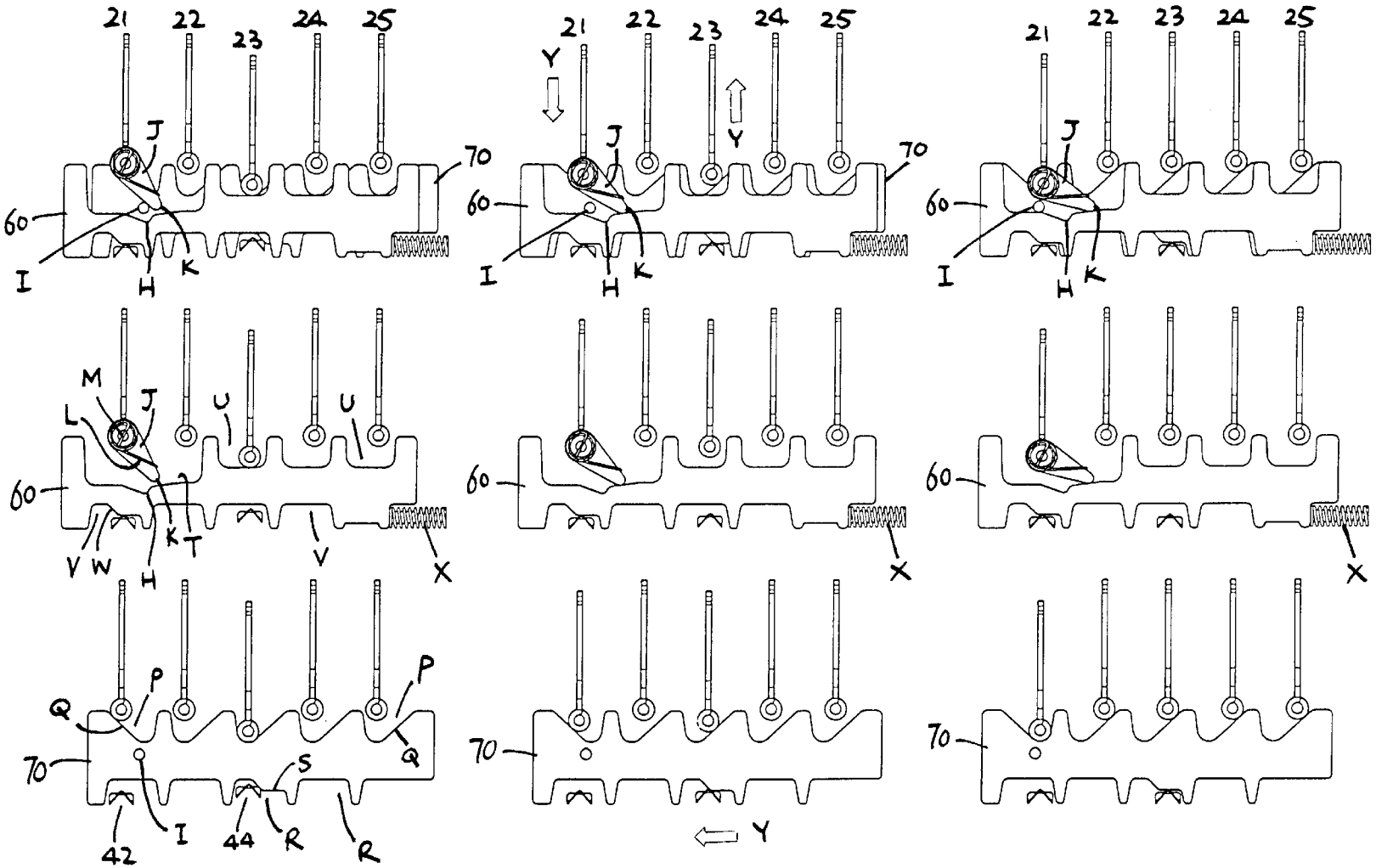
FIGS. 6A to 6C are sequential side elevational views of two internal slider blades of the switch of FIG. 1, illustrating their relative movement for one operation.

FIG. 6A shows the condition that the button 23 is down, turning on the switch C. While the slider blade 70 is in the right most position, its side peg I blocks the cam end K associated with the button 21 from engaging with the notch H of the slider blade 60 (FIG. 6A). Accordingly, depression of the button 21 (arrow Y) will lift, by means of the slider blade 70 sliding to the left position (arrow Y) (FIGS. 6B and 6C), the button 23 up (arrow Y) to turn off the switch C, without moving the slider blade 60 or, in turn, closing the switch A. Operation (5*a*) is thus performed.

Figures 7A, 7B, 7C:
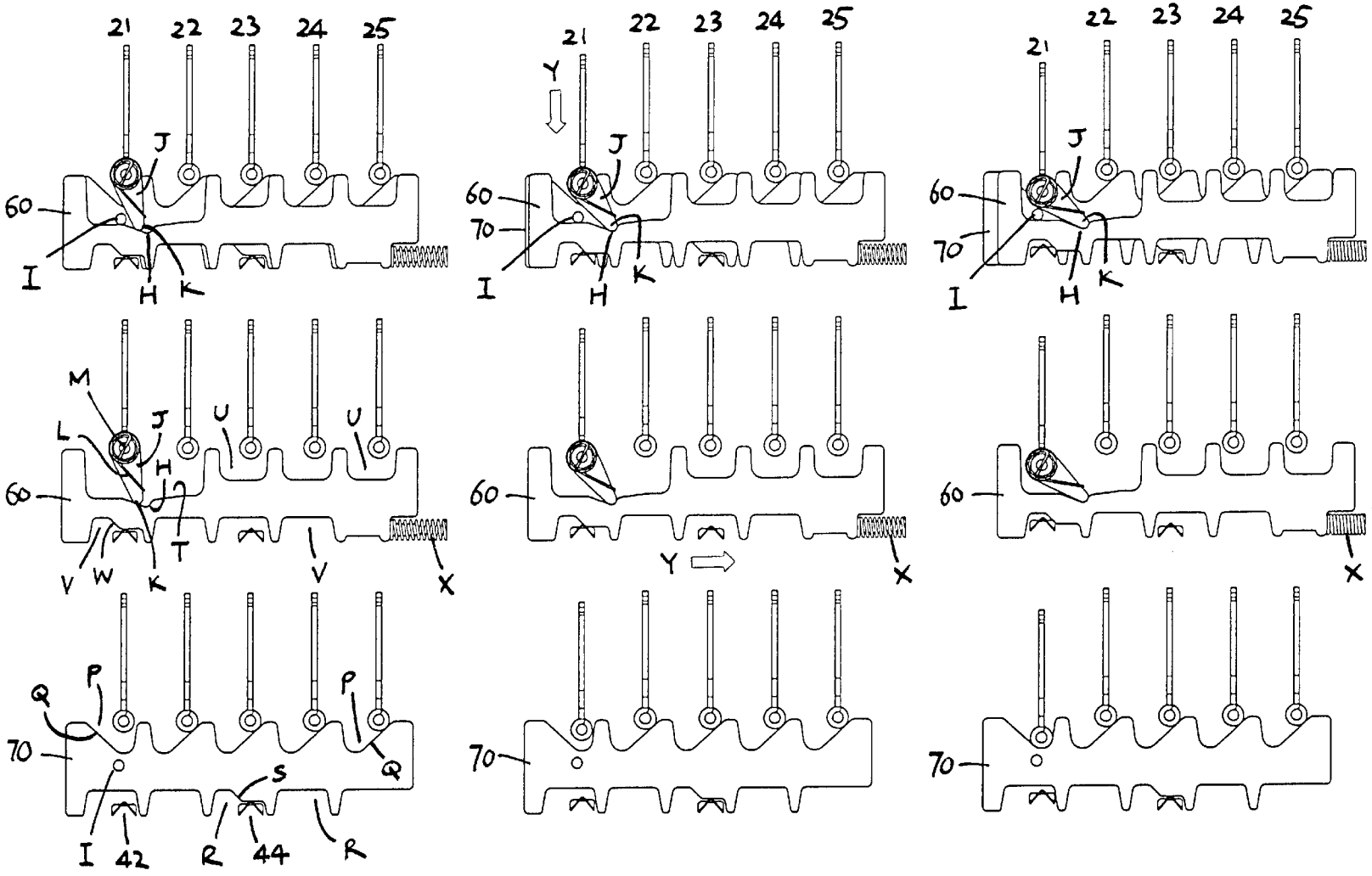
FIGS. 7A, 7B, and 7C are sequential side elevational views corresponding to FIGS. 6A, 6B, and 6C, illustrating the relative movement of the slider blades for another operation.

FIG. 7A shows the subsequent condition, in which none of the buttons 22 to 25 is down, whereby the switches B, C, and D are all turned off. While the slider blade 70 is in the left position, its side peg I is moved off the notch H, which permits the cam end K to pivot downwards and engage with the notch H. Accordingly, depression of the button 21 (arrow Y) will cause the slider blade 60 to slide to the right position (arrow Y) (FIGS. 7B and 7C), against the action of the spring X. By means of the slider blade 60, the switch A is turned on momentarily, for as long as the button 21 is kept depressed. Upon release, the button 21 will be lifted back up by the spring 26. Simultaneously, the slider blade 60 will be returned by the spring X back to the normal left position, thereby turning off the switch A. Operation (5*b*) is thus performed.

In this particular embodiment, the switch A is used exclusively for the momentary turning on action. It is envisaged that, subject to suitable modifications made to the slider blades 60 and 70 and the arrangement of the contact strips 42 to 45, any one of the other switches B, C, and D may be used also for momentarily switching on the food processor, in addition to its normal switching operation, after the processor has been switched off. In this case, the exclusive switch A may be omitted.

The invention has been given by way of example only, and various other modifications of and/or alterations to the described embodiment may be made by persons skilled in the art without departing from the scope of the invention as specified in the appended claims.

What is claimed is:

1. An electrical switch comprising:

a body, at least first, second, and third actuators, at least first, second, and third switch terminals having respective terminal parts forming at least first, second, and third internal switches, and a plurality of slider blades including cams and extending side-by-side between the actuators and the terminal parts for movement by the second and third actuators to turn on the second and third internal switches, respectively, the first actuator turning off all of the internal switches and turning on the first internal switch, the first actuator incorporating a movable cam engageable with a first slider blade of the plurality of slider blades for momentarily turning on the first internal switch after turning off all of the internal switches.

2. The electrical switch as claimed in claim 1, wherein the first slider blade is movable between a first position where the first internal switch is turned off and a second position where the first internal switch is turned on, the first slider blade being resiliently biassed towards the first position.

3. The electrical switch as claimed in claim 1, wherein the first internal switch is only momentarily turned on in response to actuation of the movable cam.

4. The electrical switch as claimed in claim 3, wherein a second slider blade of the plurality of slider blades, adjacent to the first slider blade, is movable in a first direction by the second actuator for subsequent movement in a second direction, opposite the first direction, by the first actuator to turn off the second and third internal switches.

5. The electrical switch as claimed in claim 4, wherein the second slider blade has a side protrusion engageable with the movable cam and is movable in one direction from a first position, in which the protrusion prevents the movable cam from engaging with the first slider blade, to a second position in which the protrusion permits the movable cam to engage the first slider blade.

6. The electrical switch as claimed in claim 5, wherein the first slider blade is resiliently biassed to move towards a first position turning off the first internal switch from a second position where the first internal switch is turned on, and the movable cam is resiliently biassed to pivot for engaging the first slider blade at an inclined edge, inclined in an opposite direction from a direction in which the first slider blade is resiliently biassed.

7. The electrical switch as claimed in claim 5, wherein the first slider blade is resiliently biassed to move towards a first position turning off the first internal switch from a second position where the first internal switch is turned on, the movable cam is resiliently biassed to pivot for engaging the first slider blade, and the protrusion is arranged so that the second slider blade, in the first position, blocks the movable cam from engaging the first slider blade.

8. The electrical switch as claimed in claim 1, wherein a second slider blade of the plurality of slider blades, adjacent to the first slider blade, is movable in a first direction by the second actuator for subsequent movement in a second direction, opposite the first direction, by the first actuator to turn off the second and third internal switches.

9. The electrical switch as claimed in claim 8, wherein the second slider blade has a side protrusion engageable with the movable cam and is movable in one direction from a first position, in which the protrusion prevents the movable cam from engaging with the first slider blade, to a second position in which the protrusion permits the movable cam to engage the first slider blade.

10. The electrical switch as claimed in claim 9, wherein the first slider blade is resiliently biassed to move towards a first position turning off the first internal switch from a second position where the first internal switch is turned on, and the movable cam is resiliently biassed to pivot for engaging the first slider blade at an inclined edge, inclined in an opposite direction from a direction in which the first slider blade is resiliently biassed.

11. The electrical switch as claimed in claim 9, wherein the first slider blade resiliently biassed to move towards a first position turning off the first internal switch from a second position where the first internal switch is turned on, the movable cam is resiliently biassed to pivot for engaging the first slider blade, and the protrusion is arranged so that the second slider blade, in the first position, blocks the movable cam from engaging the first slider blade.

12. The electrical switch as claimed in claim 1, wherein the movable cam is supported by the first actuator and is resiliently biassed to pivot towards a position engaging the first slider blade.

13. The electrical switch as claimed in claim 1, wherein the first slider blade includes a notch for engagement by the movable cam.

* * * * *